US006314628B1

(12) United States Patent
Crook

(10) Patent No.: US 6,314,628 B1
(45) Date of Patent: Nov. 13, 2001

(54) WARP CHANGING APPARATUS

(75) Inventor: George Crook, Ramsbottom (GB)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/341,674

(22) PCT Filed: Jan. 22, 1998

(86) PCT No.: PCT/GB98/00198

§ 371 Date: Dec. 20, 1999

§ 102(e) Date: Dec. 20, 1999

(87) PCT Pub. No.: WO98/32905

PCT Pub. Date: Jul. 30, 1998

(30) Foreign Application Priority Data

Jan. 24, 1997 (GB) ..... 9701446

(51) Int. Cl.[7] ..... D03J 1/00; B65H 67/06

(52) U.S. Cl. ..... 28/208; 28/201

(58) Field of Search ..... 28/201, 208, 172.1, 28/190, 193, 194, 196, 197, 202, 205, 206, 207.1; 139/1 R; 414/253, 259, 260, 233, 234, 235, 911

(56) References Cited

U.S. PATENT DOCUMENTS

| | | | | |
|---|---|---|---|---|
| 1,304,846 | * | 5/1919 | Blair | 28/208 |
| 1,304,875 | * | 5/1919 | Hathaway et al. | 28/208 |
| 2,579,730 | * | 12/1951 | Eurey | 28/208 |
| 2,706,056 | * | 4/1955 | Talley et al. | 28/201 |
| 2,994,939 | * | 8/1961 | Matthews | 28/208 |
| 3,433,499 | * | 3/1969 | Meierhofer | 28/201 |
| 3,612,395 | * | 10/1971 | English | 238/122 |
| 3,703,869 | * | 11/1972 | Randell | 104/23 FS |
| 4,148,406 | * | 4/1979 | Kutzschebauch | 28/201 |
| 4,630,543 | * | 12/1986 | McQueen | 104/173.1 |
| 4,910,837 | | 3/1990 | Fujimoto et al. | 28/208 |
| 5,371,930 | * | 12/1994 | Lindenmueller et al. | 28/208 |
| 5,394,596 | * | 3/1995 | Lindenmuller et al. | 28/208 |
| 5,775,380 | * | 7/1998 | Roelstraete et al. | 28/201 |

FOREIGN PATENT DOCUMENTS

| | | |
|---|---|---|
| 37 08 598 | 10/1987 | (DE) . |
| 43 10 838 | 10/1994 | (DE) . |
| 0 592 807 | 4/1994 | (EP) . |

* cited by examiner

*Primary Examiner*—Amy B. Vanatta
(74) *Attorney, Agent, or Firm*—Caesar, Rivise, Bernstein, Cohen & Pokotilow, Ltd.

(57) ABSTRACT

Apparatus for use in mounting and dismounting a warp beam, loaded with cannisters of warp thread onto or from a loom includes a trolley, with a hoverpad mounted under the trolley, and with a bracket carrying warp healds and reels. Trolleys may be combined, to carry two beams together, one trolley being arranged at the end of each beam, and the respective end trolleys being connected to the trolley in front of or behind it.

13 Claims, 3 Drawing Sheets

WARP CHANGING APPARATUS

The present invention relates to a warp changing apparatus.

Woven fabrics are woven on the loom by passing the weft yarns through a shed formed between adjacent warp yarns, the warp yarns running perpendicular to the length of the loom. These warp yarns are threaded through healds which each consist of a vertically oriented wire having an eyelet at the base thereof through which an individual warp yarn is threaded. During weaving a shed is formed by raising a heald and consequently the warp yarn threaded through the heald eyelet. After passing through the healds the warp yarns also pass through a reed to ensure a straight path for these yarns.

Warp yarns are stored on cannisters, often referred to as cans, which are large spools. The cans are mounted on a beam running parallel with and behind the loom. The warp yarn is loaded onto the cans in the so-called warping process in which a plurality of yarns are fed onto each can from a series of individual bobbins. These yarns are fed from the bobbins through a reed and are then wound onto the can.

In some prior art installations the cans are stored in the loom on two beams, one above the other, with each beam being made up of smaller shafts each supporting two cans. A mobile gantry is moved into position behind the loom to support the empty cans whilst the shaft is removed. The empty cans are then loaded onto carts in order to return them to the warping area. Full cans are then moved into position and the shaft re-inserted back into the pair of cans. This is repeated along the entire length of the loom which may contain in the region of 30 warp cans on one beam. Warp cans need to be replaced on both the upper and lower beams, with the operators replacing both the upper and lower can pairs in an alternating fashion. This is a very time consuming task taking around 8 to 16 hours per loom.

With the full cans moved into position the warp yarns then have to be threaded through the loom. In brief this is done by passing each yarn from the upper and lower cans around several guide rolls and finally a master guide roll and then through the healds and through the reed. This is another time consuming job requiring a minimum of two operators, one "the reacher" at the back of the loom to pass yarns through the healds and another "the drawer" at the front of the loom to take yarns from the machine and pass them through the reed. This would typically take one to three weeks.

A new loom design aims to solve this problem by providing larger beams with a central flange. The beam is at least 5.0 m in length having a 300–700 mm diameter shaft holding up to 30 cans (e.g. 27 cans split into sections of 13 and 14 cans on either side of the central flange) or a full beam. This type of loom allows the healds to be lowered into the top of the loom. A standard loom does not allow this because the healds are loaded from underneath, since a so-called superstructure is normally present in the top of the loom, running along its entire length, to weigh down the loom and prevent it from lifting up during weaving. The support structure for the top beam also lifts back to aid installation of the bottom beam.

U.S. Pat. No. 4,910,837 (Fujimoto et al) describes a warp beam carriage towed by an unmanned tractor, and guided by tracks parallel to the back of the loom, being halted automatically and the required positions to exchange a loaded beam for an empty beam. This installation is inflexible, and if a tractor fails on the track, it cannot be bypassed to continue with loading.

According to a first aspect of the present invention there is provided a warp changing apparatus comprising a warp beam support and a hoverpad operative to facilitate or aid movement of the warp beam support along the ground.

In a preferred embodiment of the invention the hoverpad is located at the underside of the base of the warp beam support. One or more hoverpads may be used.

The hoverpad or hoverpads are ideally located substantially in the middle of the underside of the warp beam support. Wheels and/or rollers may further be provided at the underside of the warp beam support.

Advantageously a warp changing apparatus of the invention further comprises a warp beam support, a reed support and a heald support, the reed support and heald support being mounted on an arm such that the reed support and heald support may be moved between a raised position and a lowered position.

The arm preferably comprises two pivot joints which facilitates the collapse of the arm in a manner which does not affect the orientation of the reed support and heald support. The reed support and heald support preferably comprise a housing.

A warp changing apparatus according to the invention may further comprise a warp beam support, wherein the warp changing apparatus further comprises at least one drive shaft operable to cause rotation of at least one cannister or roll beam located on the warp beam so as to adjust the tension of the warp wrapped around the said cannister or roll beam, wherein means are provided for causing rotation of the drive shaft, said means being located on the warp beam support at a location that does not obstruct access to the support by the beam.

In a preferred embodiment of the invention an individual drive wheel is provided on the shaft for engagement with each cannister to be located thereon.

The apparatus of the invention facilitates a far quicker change of warp yarns, taking less than 24 hours, compared with the standard 1–3 weeks using conventional apparatus. Hoverpad trucks enable heavy loads of between 10–30 tonnes to be easily maneuvered by a single operator. The trucks are relatively small and are therefore easy to store and guide around the factory, and are useful for transporting any item of heavy machinery, or component such as rollers, shafts, beams, etc., for instance during filament winding or wire drawing.

Furthermore, packages of healds, reeds and drawn-in yarns can be removed as single units. For example, if a relatively uncommon warp yarn was being woven on the loom, rather than having the loom sit idle for weeks waiting for another order, the partly-full beams could be removed together with the reed, healds and yarns (still in the healds and reed), due to the collapsible arm and ability to allow for giving or taking off slack on the warp yarns during maneuvering. Then the warp yarns are cut between the heald and cans, allowing the heald/reed, drawn-in yarns and partly-full cans to be stored separately for later use when these entities would be replaced in the loom and the yarns knotted together, saving the need to re-draw in all the yarns through the healds and reed again.

The collapsible bracket avoids the need to lift the bottom beam to allow the truck to leave the loom, and it can also be removed to allow the truck to transport cans or beam-supported cans to conventional looms. Cannisters are easy to load onto the trucks, especially since they are not end-driven. Therefore there is no gear box or bearing at the end of the trucks to drive the rollers. These would normally have to be removed before putting the cans on the shaft. The warp changing apparatus may be used for example in weaving papermaking fabrics or weaving of carpets.

In order that the present invention may be more readily understood a specific embodiment thereof will now be described by way of example with reference to the accompanying drawings in which.

Figure 1:
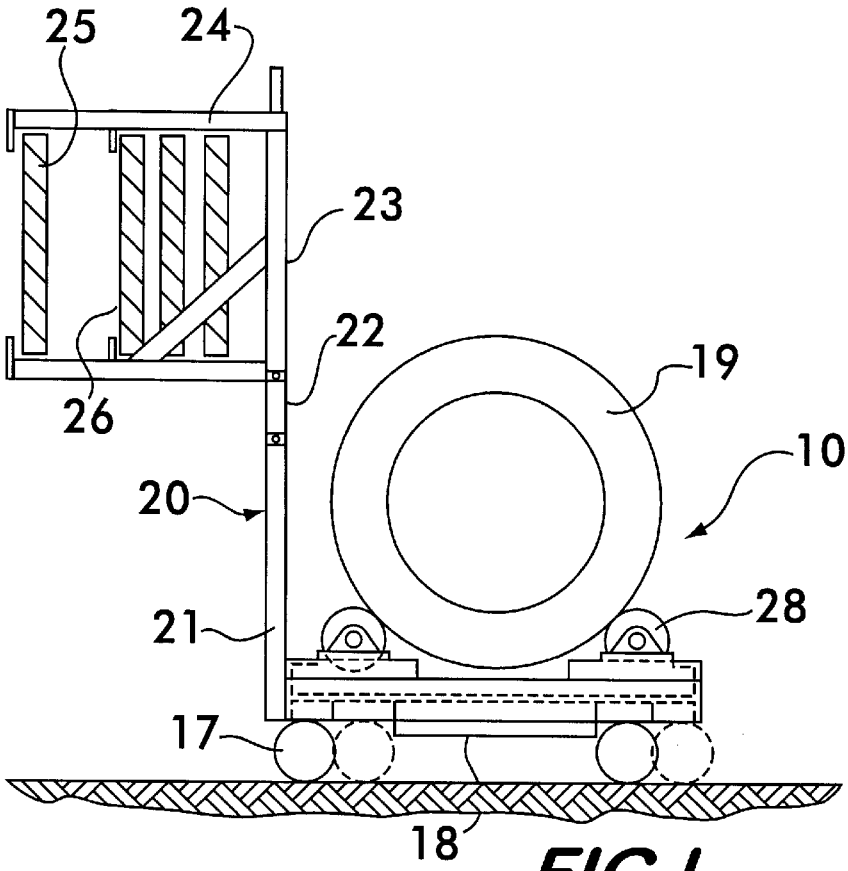
FIG. 1 is a diagrammatic illustration of a warp changing apparatus in accordance with the present invention.

Referring to the drawings a warp changing apparatus 10 comprises a truck comprising a base 11 and four vertical walls 12,13,14,15. A semi-circular recess 16 is provided in each of the opposing side walls 12,13. No recess is provided in the front and rear upstanding walls. A wheel 17 is provided at each corner of the base of the track. Furthermore a hoverpad 18 is provided at the base of the truck.

In order to load a warp system into the loom a full can is pushed up a ramp onto a truck as illustrated in the drawings. The can 19 comprises a tubular spool having flanges on either side thereof. The spool is operative to be received on the beam with a snug fit. A channel is provided in the interior spool wall which defines the aperture through the tube. A groove is also provided in the beam. A keyway is operative to be received in the said channel and is affixed thereto by way of an alun key lock. When the keyway is received in the groove and channel simultaneously, the cans are restrained from rotation about the beam.

Prior to loading the cans on the beam the aperture through the can is aligned with the beam. The keyway is removed from the can and the can is located on the beam. At this stage the can may rotate freely about the beam. The keyway is now locked into position to prevent this rotation. All of the cans, but one are now located on that end of the beam. It is noted that the beam has a flange provided at roughly the centre of its longitudinal axis. The final can for that end of the beam is simply moved by the truck until the aperture through the can is aligned with the end of the beam. This final can is then simply slipped over the shaft and is locked in position by its keyway. This final can rests on the truck and therefore the truck supports one end of the beam for transportation. The above steps are repeated for the other end of the beam until all of the cans are received on the beam and a truck is also provided for supporting the other end of the beam. It is noted that during the leading operation the horizontal position of the beam is regulated by jacks beneath it. The jacks may be located on the truck or may be separate units located on the ground.

Figure 3:
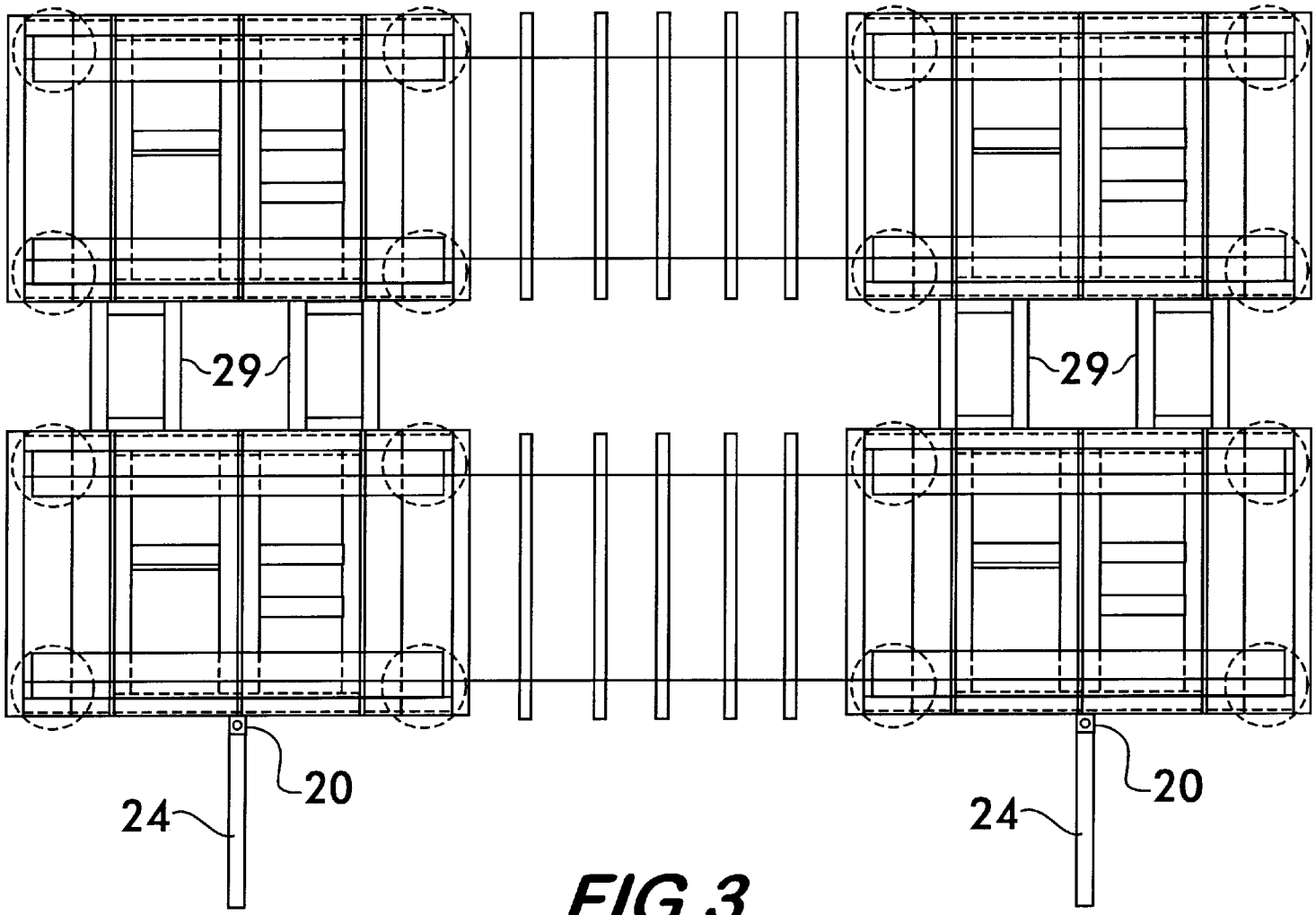
FIG. 3 is a plan view of four warp changing apparatus in accordance with the present invention when in use.

The above steps are repeated for the second beam. The trucks supporting the two beam may then be hitched together as shown in FIG. 3.

Figure 2:
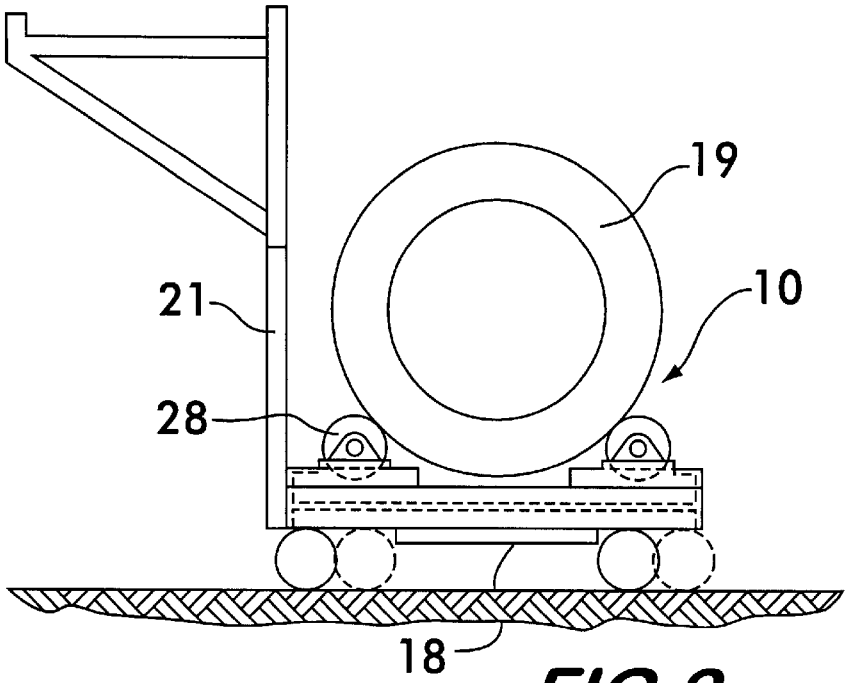
FIG. 2 is a diagrammatic illustration of the warp changing apparatus of FIG. 1 in a second arrangement.

Referring to FIGS. 1 and 2 a bracket 20 is illustrated at the front of and above the can in the truck. The bracket has three sections 21,22,23. The lower section 21 of the bracket is fixed to the front of the truck. The base of the middle section 22 of the bracket is secured to the top of the lower section 21 by a pivot joint such that the middle section may move between a vertical position as shown in FIG. 1 to a horizontal position as shown in FIG. 2. The base of the upper section 23 of the bracket is secured to the top of the middle section of the bracket via a pivot such that the upper section maintains its vertical orientation as the middle section of the bracket moves between the vertical and horizontal positions.

The upper section of the bracket comprises a housing 24 for the reed 25 and healds 26 of the warp system. The yarns from the charged cans are located on the truck and may be fed to the healds 26 and reed 25 in the bracket housing 24. As in the prior art system two people would generally carry out this task. However, here the work may be done by two operators sitting on chairs rather than being precariously balanced on equipment inside the loom as in the prior art systems. This is a frequent cause of injuries and strains.

The truck may be moved forward on the hoverpad 18 or hoverpads onto the back of the loom. This allows large loads to be moved by a single operator. An overhead crane is used to lift the reed 25 and healds 26 out of the bracket into the loom. During the lifting of the reed 25 and healds 26 the beams are rotated to move the yarns slack to thereby facilitate the maneuvring of the reed 25 and healds 26 into position. The healds 26 are preferably locked into place by simple snap-fit connections. The reed 25 is installed and clamped into position.

Figure 4:
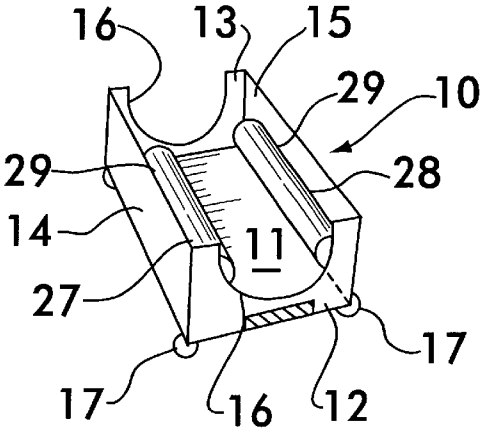
FIG. 4 is a perspective view of part of the warp changing apparatus illustrated in FIGS. 1 and 2 and FIG. 5 is an elevation view of the warp changing apparatus of FIG. 4.
Figure 5:
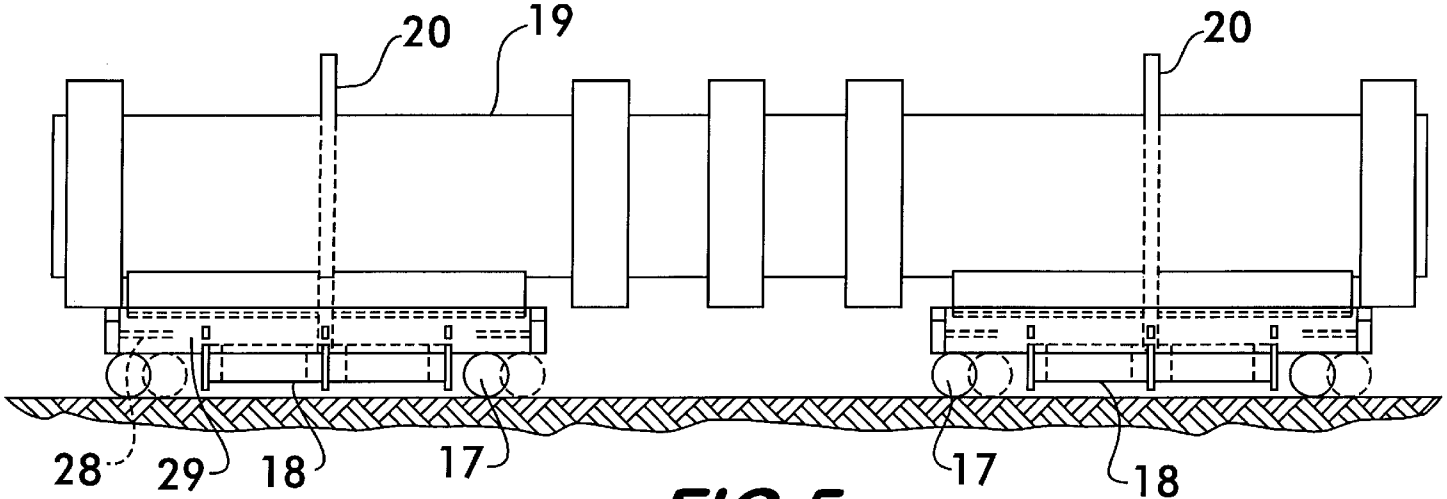

Referring to FIG. 4 drive shafts 27,28 are provided inside the truck adjacent the front and rear walls 14,15 of the truck. A plurality of wheels 29 are provided on the drive shafts 27,28. One wheel 29 is provided on each drive shaft for engagement with each can. The two shafts 27,28 are driven by one or more drive motors which are located at the rear of the truck so as not to prevent access to the truck from the sides 12,13 of the truck and thus impede beam location and removal. The drive shafts 27,28 may be driven in a clockwise or anti-clockwise direction so as to give slack or take off slack in the warp yarns.

In order to remove the tracks from the loom the drive shaft mechanism is used to take off any slack in the warp yarns. The bracket for the healds and reed is collapsed in to the position illustrated in FIG. 2 allowing the trucks to be pulled out of the loom.

The beam supported by the trucks is then lifted by the shaft ends using an overhead crane and then it is lowered so that the ends of the shaft come to rest against brackets at each end of the loom. The hoverpad is then deflated. The first pair of trucks are now resting on their wheels and can be removed from the loom. The support for the top beam which had been lifted up to make access to the back of the loom easier, is now is lowered back into position and locked against the bottom beam support. Once again the top beam is moved adjacent the back of the loom on hoverpads and the overhead crane is used to raise and lower the beam into the brackets. The truck is then removed by deflating the hoverpad and wheeling the truck away. During these steps the cans may be driven to give or take slack as required.

It is to be understood that the above described embodiment has been made by way of illustration only. Many modifications are variations are possible.

What is claimed is:

1. A warp changing apparatus comprising a warp beam support, in spatial relationship with a hoverpad operative to facilitate or aid movement of the warp beam support along the ground, wherein wheels or rollers are provided at an underside of the warp beam support.

2. A warp changing apparatus according to claim 1, said warp beam support having a base with an underside, wherein the hoverpad is located at the underside of the base of the warp beam support.

3. A warp changing apparatus according to claim 1 or claim 2, wherein said hoverpad includes one or more hoverpads.

4. A warp changing apparatus according to claim 1, wherein the hoverpad is located substantially in the middle of the warp beam support.

5. A warp changing apparatus according to claim 1 further comprising an arm extending from the warp beam support, a reed support and a heald support, the reed support and heald support being mounted on the arm such that the reed support and heald support may be moved between a raised position and a lowered position.

6. A warp changing apparatus according to claim 5, wherein the arm comprises two pivot joints which facilitates the collapse of the arm in a manner which does not affect the orientation of the reed support and heald support.

7. A warp changing apparatus according to claim 5, wherein the reed support and heald support comprise a housing.

8. A warp changing apparatus according to claim 1 further comprising at least one drive shaft operable to cause rotation of at least one cannister located on the warp beam so as to adjust the tension of the warp wrapped around the said cannister, wherein means are provided for causing rotation of the drive shaft, said means being located on the warp beam support at a location that does not obstruct access to the support by the beam.

9. A warp changing apparatus according to claim 8, wherein an individual drive wheel is provided on the shaft for engagement with each cannister to be located thereon.

10. A method of changing the warp on a loom comprising the step of moving a warp beam support according to claim 1, the movement being facilitated by a hoverpad in spatial relationship with the warp beam support, the step of moving the warp beam support including the step of rotating wheels or rollers provided at an underside of the warp beam support.

11. A method of changing the warp on a loom according to claim 10 further comprising the steps of mounting a heald support and a reed support on an arm, said arm being moveable between a raised position and a lowered position and wherein the orientation of the reed support and heald support is not affected by the movement of the arm.

12. A method of changing the warp on a loom according to claim 10 further comprising the steps of rotation of a cannister or roll beam located on a warp beam so as to adjust the tension of the warp wrapped around the cannister, supporting said warp beam on the warp beam support in spatial relationship with said hoverpad, rotation of the cannister caused by a drive shaft operable to cause rotation of at least one cannister or roll beam, wherein means for causing rotation of the drive shaft are located on the warp beam support at a location which does not obstruct access to the support by the beam.

13. A warp changing apparatus comprising a warp beam support in spatial relationship with a hoverpad operative to facilitate or aid movement of the warp beam support along the around, an arm extending from the warp beam support, a reed support and a heald support, the reed support and heald support being mounted on the arm such that the reed support and heald support may be moved between a raised position and a lowered position.

* * * * *